US005272718A

United States Patent [19]

Stenzel et al.

[11] Patent Number: 5,272,718

[45] Date of Patent: Dec. 21, 1993

[54] METHOD AND APPARATUS FOR FORMING A STREAM OF MOLTEN MATERIAL

[75] Inventors: Otto W. Stenzel, Gruendau; Georg Sick, Beilstein; Michael Hohmann, Hanau, all of Fed. Rep. of Germany

[73] Assignee: Leybold Aktiengesellschaft, Hanau, Fed. Rep. of Germany

[21] Appl. No.: 867,290

[22] Filed: Apr. 10, 1992

Related U.S. Application Data

[63] Continuation of Ser. No. 535,032, Jun. 8, 1990, abandoned.

[30] Foreign Application Priority Data

Apr. 9, 1990 [DE] Fed. Rep. of Germany ..... 40119392

[51] Int. Cl.[5] ..... H05B 7/00

[52] U.S. Cl. ..... 373/22; 373/10; 373/11; 373/15; 373/142; 373/158; 373/144; 219/7.5; 75/336; 75/338; 425/7

[58] Field of Search ..... 373/10, 11, 15, 13, 373/22, 28, 29, 33, 35, 64, 70, 142, 144, 158; 219/7.5, 10.41; 75/0.5 C, 336, 334, 337, 338, 340, 367

[56] References Cited

U.S. PATENT DOCUMENTS

| | | | |
|---|---|---|---|
| H000,128 | 9/1986 | Routt | 373/35 |
| 2,754,346 | 7/1956 | Williams | 373/35 |
| 3,387,783 | 6/1968 | Schellenberg et al. | 239/81 |
| 3,435,992 | 4/1969 | Tisdale et al. | 222/146 |
| 3,826,301 | 7/1974 | Brooks | 164/46 |
| 3,829,538 | 8/1974 | Darmara et al. | 373/70 |
| 4,048,436 | 9/1977 | Hiratake et al. | 373/22 |
| 4,069,045 | 1/1978 | Lundgren | 75/251 |
| 4,462,458 | 7/1984 | Ruer | 164/504 |
| 4,523,621 | 6/1985 | Ray | 164/46 |
| 4,612,045 | 9/1986 | Shintaku | 75/68 R |
| 4,631,384 | 12/1986 | Cornu | 219/10.41 |
| 4,639,567 | 1/1987 | Stenzel | 219/10.43 |

(List continued on next page.)

FOREIGN PATENT DOCUMENTS

| | | |
|---|---|---|
| 0238425 | 9/1987 | European Pat. Off. . |
| 0291288 | 11/1988 | European Pat. Off. . |
| 0366310 | 5/1990 | European Pat. Off. . |
| 0471798 | 11/1990 | European Pat. Off. . |
| 0427379A2 | 5/1991 | European Pat. Off. . |
| 3421488 | 6/1964 | Fed. Rep. of Germany . |
| 2109209 | 2/1971 | Fed. Rep. of Germany . |
| 3211861 | 3/1982 | Fed. Rep. of Germany . |
| 3034677 | 4/1982 | Fed. Rep. of Germany . |
| 3533964 | 9/1985 | Fed. Rep. of Germany . |
| 34334583 | 3/1986 | Fed. Rep. of Germany . |
| 3528169 | 2/1987 | Fed. Rep. of Germany . |
| 3809072 | 3/1988 | Fed. Rep. of Germany . |
| 443574 | 2/1968 | Switzerland . |
| 576302 | 6/1976 | Switzerland . |

*Primary Examiner*—Bruce A. Reynolds
*Assistant Examiner*—Tu Hoang
*Attorney, Agent, or Firm*—Felfe & Lynch

[57] ABSTRACT

A method and apparatus for forming a stream of molten material. The apparatus includes a melt container having a bottom wall in which is formed an aperture. A funnel is adapted and constructed to receive molten material from the aperture in the container, and includes a plurality of fluid-cooled metallic segments. The funnel segments define an inner funnel contour that decreases in cross-sectional area from the inlet end to the outlet end of the funnel. An electrically conductive coil surrounds the funnel, and has a shape corresponding to the outer shape of said funnel. A source of medium-frequency current in selective electrical connection with the coil. The method begins with the step of providing a predetermined quantity of molten material in a melt container. A metallic funnel is provided in fluid communication with the melt container, and includes a plurality of fluid-cooled funnel segments. The method also includes the step of providing an electrically conductive coil surrounding the funnel. When molten material flows from the melt container through the funnel, AC current is passed through the coil at an intensity sufficient to heat the molten material flowing through the funnel.

23 Claims, 2 Drawing Sheets

U.S. PATENT DOCUMENTS

| | | | |
|---|---|---|---|
| 4,723,996 | 2/1988 | Brunet | 75/10.14 |
| 4,762,553 | 8/1988 | Savage et al. | 75/336 |
| 4,770,718 | 9/1988 | Verhoeven et al. | 148/11.5 P |
| 4,787,935 | 11/1988 | Eylon et al. | 75/0.5 C |
| 4,869,469 | 9/1989 | Eylon et al. | 266/202 |
| 4,873,698 | 10/1989 | Boen | 373/158 |
| 4,881,722 | 11/1989 | Koizumi et al. | 266/176 |
| 4,962,291 | 10/1990 | Fujita et al. | 219/10.491 |
| 4,973,818 | 11/1990 | Bittenbrunn et al. | 373/15 |
| 4,987,951 | 1/1991 | Dietrich et al. | 164/466 |
| 5,004,153 | 4/1991 | Sawyer | 239/81 |
| 5,074,532 | 12/1991 | Ducrocq et al. | 266/237 |
| 5,077,090 | 12/1991 | Sawyer | 427/241 |
| 5,084,091 | 1/1992 | Yolton | 75/336 |
| 5,121,406 | 6/1992 | Hugo et al. | 373/142 |
| 5,164,097 | 11/1992 | Wang et al. | 222/590 |

METHOD AND APPARATUS FOR FORMING A STREAM OF MOLTEN MATERIAL

This is a continuation of application Ser. No. 535,032, filed Jun. 8, 1990 abandoned.

TECHNICAL FIELD

The invention relates to a method and apparatus for forming a stream of molten material, and specifically to a method and apparatus for forming a stream of molten metallic material.

BACKGROUND OF THE INVENTION

In the production of highly pure metal powders, it is common practice to "bundle" liquid metal so as to form a relatively narrow stream, so that the metal may be subsequently atomized with an atomizing nozzle or a rotating disk atomizer. In lost-wax molding processes, it is common practice to pour pure molten metallic material into a mold with a stream former.

A known method of forming streams of molten material is so-called "drop-off melting", in which a cylindrical rod of metallic material is melted and supplied to a dispersion nozzle. One example of this method is disclosed in DE-A-3 433 458. In this example, the rod of material is pushed vertically against an induction coil. The coil has a longitudinal dimension less than the length of the rod, and defines a central aperture that is smaller than the diameter of the rod. The lower end of the rod is held with its front surface at an essentially constant axial distance above the induction coil. One disadvantage of this method is that the starting material must be provided in rod form.

In another known method for forming a stream of molten metallic material, molten material is poured from a ceramic crucible. The crucible can withstand the high temperatures of the molten material, and thus has the advantage that it does not need to be cooled. However, the crucible method is disadvantageous in that the molten material may be contaminated by contact with the ceramic crucible.

To avoid contamination of the material, pouring crucibles could be fabricated from metal. However, a metal crucible would have to be cooled, thus causing the molten material to tend to solidify when poured. If moderately large crucibles of metal were employed, with the material being melted using plasma or electron beam techniques, the aperture of the crucible from which the liquid metal stream flows would solidify more rapidly in inverse relation to the width of the aperture. The crucible technique is therefore unsuitable for use with powder generating devices, since known atomizing arrangements require relatively narrow streams of material.

It is therefore apparent that the need exists for a method and apparatus for forming streams of molten material that will generate a relatively narrow stream of molten material while avoiding the risk of solidifying, as well as selectively allowing the molten material to solidify and melt again.

SUMMARY OF THE INVENTION

The present invention provides a method and apparatus for forming a stream of molten material. The apparatus includes a melt container having a bottom wall in which is formed an aperture. A funnel is adapted and constructed to receive molten material from the aperture in the container, and includes a plurality of fluid-cooled metallic segments. The funnel segments define an inner funnel contour that decreases in cross-sectional area from the inlet end to the outlet end of the funnel.

An electrically conductive coil surrounds the funnel, and has a shape corresponding to the outer shape of said funnel. A source of medium-frequency current is in selective electrical connection with the coil.

The method of the present invention begins with the step of providing a predetermined quantity of molten material in a melt container. A metallic funnel is provided in fluid communication with the melt container, and includes a plurality of fluid-cooled funnel segments.

The method also includes the step of providing an electrically conductive coil surrounding the funnel. When molten material flows from the melt container through the funnel, AC current is passed through the coil at an intensity sufficient to heat the molten material flowing through the funnel.

One advantage achieved with the invention is that the molten material is heated inductively in the pouring funnel, so that the effect of potentially cooling contact between the material and the funnel wall is reduced. It is thus possible to keep the thermal transmission coefficient between material and the container low. Consequently, it is possible to maintain a small outflow stream diameter, for example in the range of 5 mm to 20 mm, without solidification or contamination of the material.

Other objects and advantages of the present invention will become apparent upon reference to the accompanying description when taken in conjunction with the following drawings.

DETAILED DESCRIPTION OF THE PREFERRED EMBODIMENTS

Figure 1:
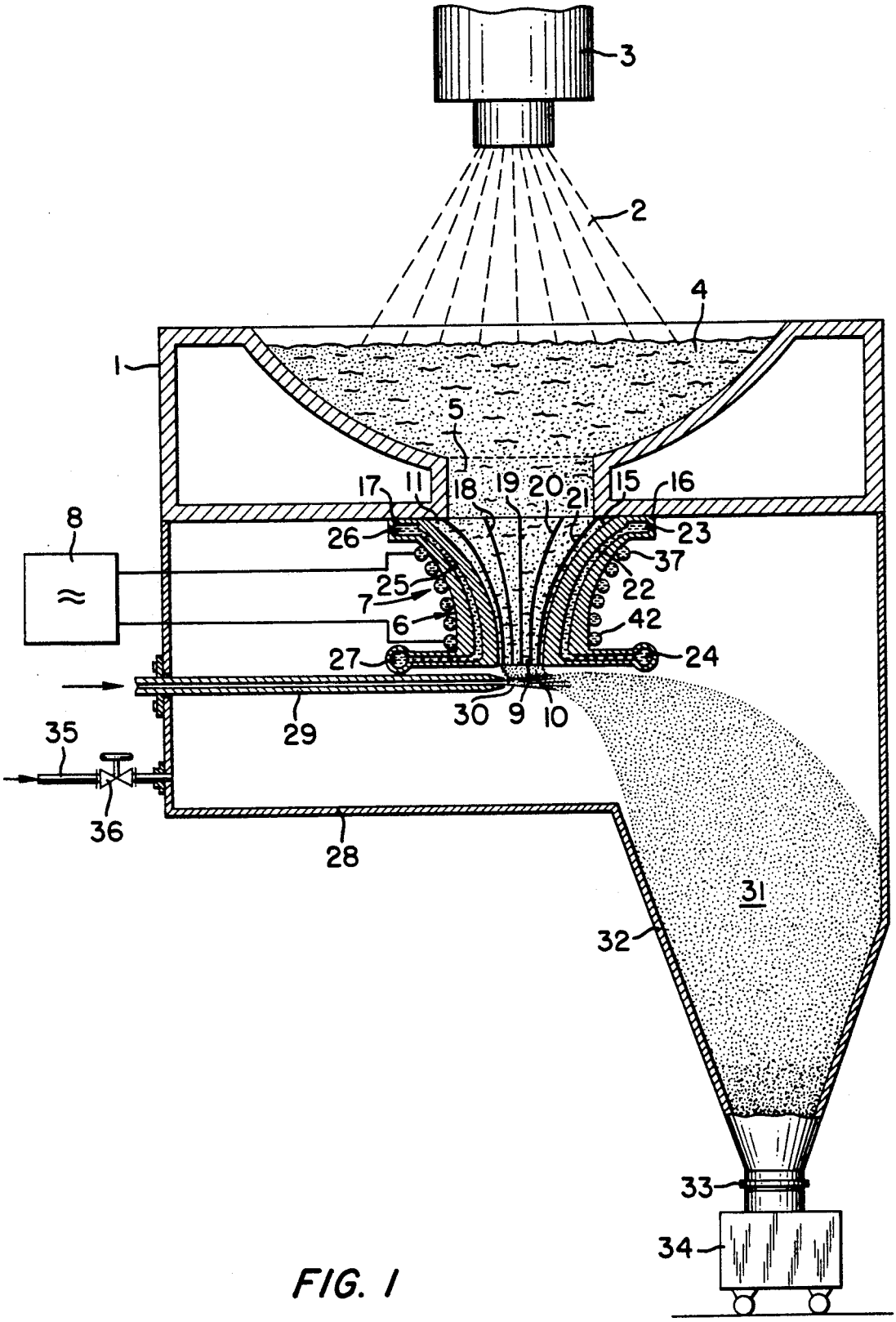
FIG. 1 is a schematic sectional view illustrating an embodiment of the present invention.

FIG. 1 shows a melt container 1 in which a plasma beam 2 emanating from a plasma gun 3 is used to maintain a quantity of metallic material 4 in a liquid, molten state. The melt container 1 includes an aperture 5. A funnel-form slit cold induction crucible 6 is disposed adjacent the aperture 5, and is adapted and constructed to receive molten material from the container 1. The funnel 6 shown in FIG. 1 has an inner contour that is in the form of a paraboloid of revolution, but it is also contemplated that the inner contour could be conical.

The funnel 6 decreases in cross-sectional area from its inlet end to its outlet end, and terminates in an aperture 9. Molten metallic material 10 flows from the container 1, through the funnel 6, and out the aperture 9.

The cold funnel 6 can be formed from a plurality of funnel segments 11 to 17 separated by slots 18 to 21. The funnel segments 11 to 17 are cooled by water supplied to channels 22, 25 via ring distributors 23, 24, 26, 27. Such cooled segments are know per se (see for example EP-A-0 276 544).

The funnel 6 is surrounded by an induction coil 7 which has a shape that corresponds to the outer shape of the funnel 6. The induction coil 7 is connected with an AC current source 8. The coil 7 has an induction field that acts upon the molten material in the funnel 6, serving to heat the material.

A dispersion chamber 28 is disposed underneath the funnel 6. A gas jet apparatus 29 extends into the dispersion chamber 28 from a sidewall thereof. A high-velocity gas jet 30 from the jet apparatus 29 is directed precisely onto the stream of molten material 10 issuing from the aperture 9 of the funnel 6. The gas jet 30 intersects with the material 10 at a predetermined point and at a predetermined angle, and disperses the material 10 into a stream of extremely fine metal particles 31. The force of the gas jet 30 causes the flight path of the metal particles 31 to describe a generally parabolic arc. The particles 31 fall through a collection chute shaft 32 which extends laterally of and downwardly from the dispersion chamber 28.

A delivery sluice 33 is connected to the lower end of the chute 32, and facilitates passage of the particles 31 from the chute 32 to a transport vehicle 34.

A gas line 35 with a metering valve 36 also extends into the dispersion chamber 28. Through the gas line 36, the entire dispersion chamber, chute, and sluice arrangement can be filled with a protective gas. Alternatively, the chamber 28 could be evacuated using a vacuum arrangement (not shown).

The average power density of the power induced in the material passing through the funnel 6 is selected to be of sufficient magnitude to compensate for any thermal losses in the funnel 6.

Also of importance are the electromagnetic forces which exert a pressure on the material in funnel 6, and which are generated by the coil 7 with windings 37 to 42. This pressure is determined by power density, which can be calculated by the following formula:

$$P = \frac{1}{2\pi f\delta} S_0 \left[ 1 - e^{-\frac{2x}{\delta}} \right]$$

Wherein:

f is the frequency of the ac field;

$\delta$ is the penetration depth;

$s_0$ is the power density streaming in over the surface;

e is Euler's number; and x is the distance from the surface of the material in the funnel 6 in the direction toward the funnel axis.

The thermal transmission coefficient of the funnel 6 depends in part upon the fluid pressure of the molten material in the funnel, which acts to press the material against the funnel segments 11 to 17. The coil 7 exerts an electromagnetic force on the material passing through the funnel that tends to compensate for, or counteract, this fluid pressure by urging the material away from the inner funnel surface. The electromagnetic force is greater at the slots 18 to 21 than in the stay centers. The flow rate of molten material through the funnel can be determined by appropriate selection of the current ampere turns per cm of the coil.

If the electromagnetic force exerted by the coil is great enough to cause material passing through the funnel to lift completely off of the inner funnel wall over a large area, flow through the funnel will become unstable. If the electromagnetic force is so great that the material is pushed back nearly to the funnel axis, the resultant surface tension in the material can cause flow to be completely stopped. Both of these conditions present potential problems in maintaining proper material flow. Consequently, the effect of the electromagnetic force on the material in the funnel 6 must be controlled to avoid turbulent flow and flow stoppage of the material.

Such control can be affected at least in part by providing the funnel 6 with an inner contour that is conical in shape, or is a hyperboloid of revolution. From an engineering standpoint, it is easier to manufacture a funnel having a conical inner contour than it is to manufacture a funnel having a hyperbolic inner contour. However, the hyperbolic inner contour affords superior fluid dynamics for the material passing through the funnel. Curved segments 11 to 15 are difficult to manufacture, but they provide better force and power distribution in the material passing therethrough. Moreover, the hyperbolic shape approximates very closely the fluidic "ideal shape" of a potential funnel.

In order to optimize the heating capabilities and the electromagnetic force of the coil 7, the frequency of the power source 8 should be selected in accordance with the characteristics of the specific metallic material to be processed. Heavier materials that exert relatively high fluid pressures against the inner funnel contour tend to increase thermal transmission through the funnel. Higher induction power is required to compensate for the increased heat losses that accompany increased thermal transmission. Unless the geometry of the funnel inner contour is properly designed for optimal electrical efficiency, an unnecessarily large current supply is required.

As an alternative to the horizontally-directed gas jet apparatus 29 as shown in FIG. 1, the present invention also contemplates that a vertically-directed gas jet apparatus, or a rotational dispersion apparatus, can also be provided. A standing wave generation is also conceivable. Of course, in lost-wax molding processes no metal powder is produced, so that the entire atomization or dispersion device is dispensed with.

In place of the container 1, metallic water-cooled containers or cooled containers with separate induction coils can be provided. The plasma beam generator 3 can also be replaced by an arc or an electron beam heating system.

Figure 2:
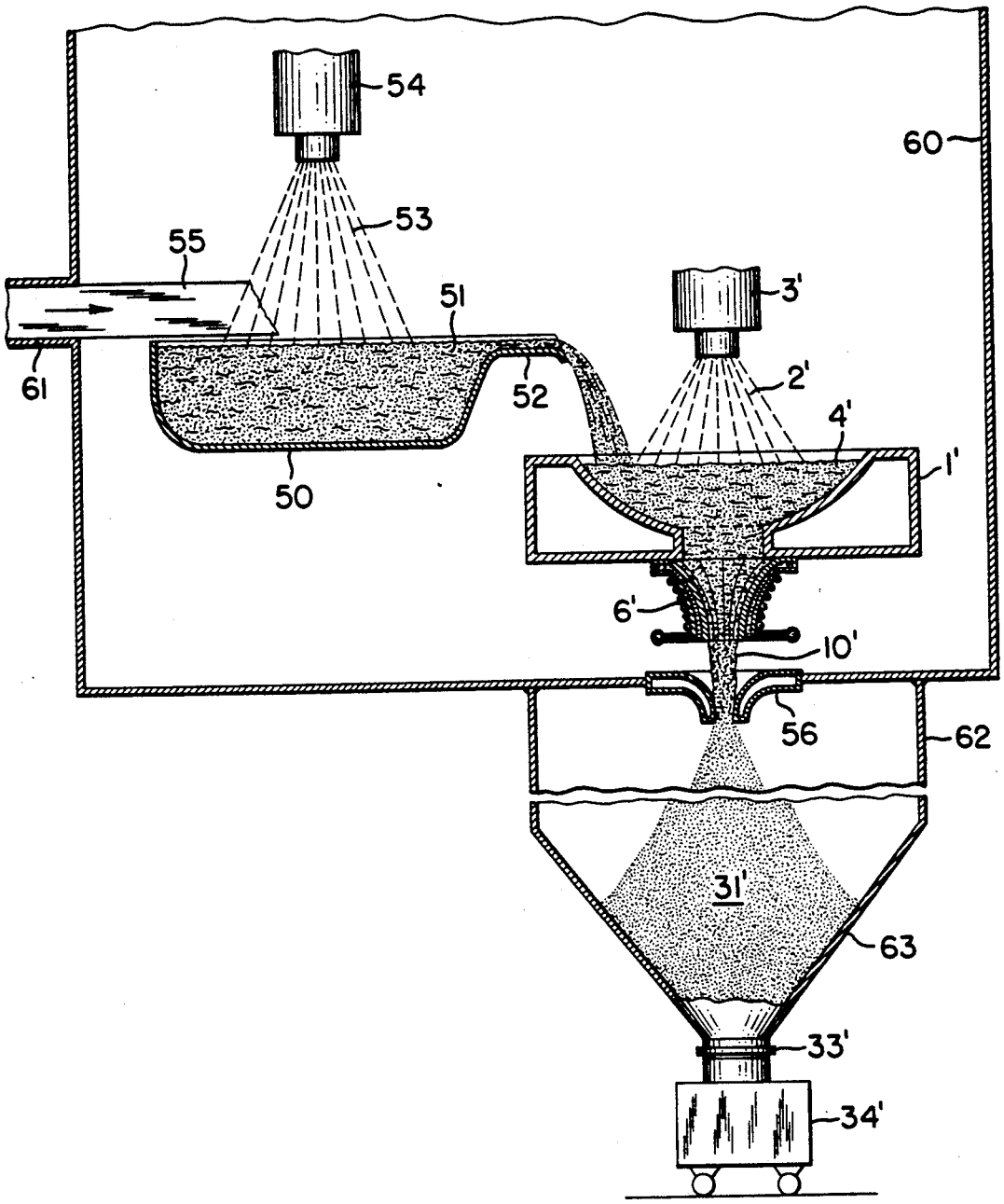
FIG. 2 is a schematic sectional view illustrating another embodiment of the present invention.

Another embodiment of the invention is illustrated In FIG. 2. In this embodiment, an overflow vat 50 is provided from which molten material 51 flows via an outlet 52 into the melt container 1'. The material 51 of this overflow vat 50 is fed by a plasma beam 53 from a plasma source 54 which melts a rod 55 pushed into the plasma beam 53.

Instead of a horizontally-directed jet, a vertically-directed annular jet apparatus 56 is provided which vertically atomizes the stream 10' coming out of the funnel 6'. A relatively large chute 62 (the upper part of which is not shown in its entirety) terminates in a conical powder chute 63, in which the atomized powder collects.

Although the present invention has been described with reference to a specific embodiment, those of skill in the art will recognize that changes may be made thereto without departing from the scope and spirit of the invention as set forth in the appended claims.

We claim as our invention:

1. A method of forming a stream of molten material, said method comprising the following steps:

providing a predetermined quantity of molten material in an upwardly concave melt container;

providing a metallic funnel in fluid communication with said melt container, said funnel including a plurality of circularly arranged vertical fluid-cooled funnel segments defining an inner funnel contour;

providing a coil surrounding said funnel, said coil being capable of conducting AC current;

causing molten material from said melt container to flow through said funnel, said molten material being received and directed through said funnel by said inner funnel contour; and passing AC current through said coil to heat said molten material flowing through said funnel.

2. A method according to claim 1, further comprising the step of controlling the flow rate of said molten material through said funnel by selecting a predetermined number of current ampere turns per cm of said coil.

3. A method according to claim 1, further comprising the step of maintaining a mean power density induced by said molten material to compensate for heat losses of said funnel.

4. A method according to claim 1, wherein:

said coil exerts an electromagnetic force on said molten material; and said method further comprises the step of maintaining said electromagnetic force to offset fluid pressure exerted by said molten material.

5. A method according to claim 1, further comprising the following steps:

maintaining a mean power density induced by said molten material to compensate for heat losses of said funnel; and said method further comprises the step of maintaining an electromagnetic force exerted on said molten material by said coil to offset fluid pressure exerted by said molten material.

6. An apparatus for forming a stream of molten material, said apparatus comprising, in combination, the following:

an upwardly concave container including a bottom wall in which is formed an aperture, said container being adapted and constructed to receive and retain a predetermined quantity of molten metallic material;

a funnel having an inner funnel contour adapted and constructed to receive molten material from said aperture in said container, said funnel including a plurality of circularly arranged, vertical fluid-cooled metallic segments defining said inner funnel contour whereby said inner funnel contour decreases in cross-sectional area from an inlet end to an outlet end of said funnel;

an electrically conductive coil surrounding said funnel and having a shape corresponding to an outer shape of said funnel; and a source of medium-frequency current in connection with said coil.

7. An apparatus according to claim 6, wherein said inner contour of said funnel is generally conical.

8. An apparatus according to claim 6, wherein said inner contour of said funnel is a hyperboloid of revolution.

9. An apparatus according to claim 6, further comprising a generally horizontally-directed atomization device, disposed at said outlet end of said funnel, for providing pressurized gas to atomize said molten material.

10. An apparatus according to claim 9, further comprising an overflow vat adapted and constructed to provide molten material to said container.

11. An apparatus for forming stream of molten material, said apparatus comprising:

an inlet portion defining an inlet opening receiving molten material;

a tapering portion connected with said inlet portion, said tapering portion comprising:

an inner surface means tapering generally inwardly of the tapering portion and away from the inlet opening, said inner surface means defining a tapering space communicating with said inlet opening and receiving molten material therefrom;

fluid cooling means for cooling the tapering portion during transmission of molten material therethrough being operatively associated with said tapering portion;

an outer surface means tapering generally inwardly of the tapering portion and away from the inlet portion;

induction coil means extending around said outer surface means and tapering inwardly therewith;

alternating current supply means connected with the induction coil means for applying alternating current thereto, said induction coil means heating molten material in said tapering space, exerting an electromagnetic force on molten material in said tapering space, and reducing fluid pressure thereof on the inner wall means responsive to supply of alternating current from said alternating current supply means; and an outlet portion connected with said tapering portion, said outlet portion defining an outlet opening smaller in cross-sectional area than the inlet opening and communicating with said tapering space and receiving said molten material therefrom;

said inner surface means having a contour extending generally convexly into said tapering space.

12. The invention according to claim 11, wherein said inner surface means has a contour which is generally a paraboloid of revolution.

13. The invention according to claim 12, wherein said inner surface means comprises a plurality of segments, and said fluid cooling means is operatively associated with each of said segments and cools said segments when molten material passes through said tapering portion.

14. The invention according to claim 11, wherein said inner surface means comprises a plurality of segments, and said fluid cooling means is operatively associated with each of said segments and cools said segments when molten material passes through said tapering portion.

15. The invention according to claim 11, wherein said inner surface means has a contour which is generally a paraboloid of revolution.

16. The invention according to claim 15, wherein said inner surface means comprises a plurality of segments, and said fluid cooling means is operatively associated with each of said segments and cools said segments when molten material passes through said tapering portion.

17. The invention according to claim 16, wherein said outer surface means and said induction coil means taper inwardly with a generally concave tapering exterior contour conforming generally with the convex contour of said inner surface means.

18. The invention according to claim 13, wherein said outer surface means and said induction coil means taper inwardly with a generally concave tapering exterior contour conforming generally with the convex contour of said inner surface means.

19. The invention according to claim 14, wherein said outer surface means and said induction coil means taper inwardly with a generally concave tapering exterior contour conforming generally with the convex contour of said inner surface means.

20. The invention according to claim 11, wherein said outer surface means and said induction coil means taper inwardly with a generally concave tapering exterior contour conforming generally with the convex contour of said inner surface means.

21. An apparatus for forming stream of molten material, said apparatus comprising:

an inlet portion defining an inlet opening receiving molten material;

a tapering portion connected with said inlet portion, said tapering portion comprising:

an inner surface means tapering generally inwardly of the tapering portion and away from the inlet opening, said inner surface means defining a tapering space communicating with said inlet opening and receiving molten material therefrom;

fluid cooling means for cooling the tapering portion during transmission of molten material therethrough, said fluid cooling means extending between the inner and outer surface means;

an outer surface means tapering generally inwardly of the tapering portion and away from the inlet portion;

induction coil means extending around said outer surface means and tapering inwardly therewith;

alternating current supply means connected with the induction coil means for applying alternating current thereto, said induction coil means heating molten material in said tapering space, exerting an electromagnetic force on molten material in said tapering space, and reducing fluid pressure thereof on the inner wall means responsive to supply of alternating current from said alternating current supply means; and an outlet portion connected with said tapering portion, said outlet portion defining an outlet opening smaller in cross-sectional area than the inlet opening and communicating with said tapering space for receiving said molten material therefrom;

said inner surface means comprising:

an upper inner surface portion adjacent the inlet opening, said upper inner surface portion extending therefrom generally obliquely downwardly and inwardly of the tapering portion;

an intermediate inner surface portion connected with the upper inner surface portion and extending curvingly downwardly therefrom; and a lower inner surface portion connected with the intermediate inner surface portion and extending substantially vertically downwardly therefrom.

22. The invention according to claim 21 and said outer surface means comprising:

an upper outer surface portion adjacent the inlet opening, said upper outer surface portion extending generally obliquely downwardly away from the inlet portion and inwardly of the tapering portion;

an intermediate outer surface portion connected with the upper outer surface portion and extending curvingly downwardly therefrom; and a lower outer surface portion connected with the intermediate outer surface portion and extending therefrom substantially vertically downwardly therefrom.

23. The invention according to claim 22 and the coil means tapering inward with a contour substantially conforming to the outer contour of said outer surface means.

* * * * *